United States Patent [19]

Dow et al.

[11] 4,198,199

[45] Apr. 15, 1980

[54] LAMP WITH PROTECTIVE COATING AND METHOD OF APPLYING SAME

[75] Inventors: Judith A. Dow, Boston; Thomas J. Sentementes, Wakefield; Horace H. Homer, Arlington, all of Mass.; John W. Shaffer, Williamsport, Pa.

[73] Assignee: GTE Sylvania Incorporated, Stamford, Conn.

[21] Appl. No.: 753,255

[22] Filed: Dec. 22, 1976

[51] Int. Cl.[2] ..... F21K 5/02

[52] U.S. Cl. ..... 431/360; 313/312; 427/55

[58] Field of Search ..... 431/94, 360; 427/44, 427/54, 106, 108; 240/1.3, 46.49; 313/110, 489, 312; 428/428, 430, 431

[56] References Cited

U.S. PATENT DOCUMENTS

| | | | |
|---|---|---|---|
| 2,438,993 | 4/1948 | DeBoer | 431/94 |
| 3,554,887 | 1/1971 | Feehs | 204/158 |
| 3,832,125 | 8/1974 | McDonough et al. | 431/94 |
| 3,893,797 | 7/1975 | Hough et al. | 431/94 |
| 3,947,224 | 3/1976 | Shaffer | 431/94 |
| 3,959,525 | 5/1976 | Sentementes et al. | 431/94 |
| 3,961,099 | 6/1976 | Gipstein et al. | 240/159.19 |
| 3,992,276 | 11/1976 | Powanda et al. | 427/54 |
| 4,008,341 | 2/1977 | Kehr | 427/54 |
| 4,017,652 | 4/1977 | Gruber | 427/54 |
| 4,076,489 | 2/1978 | Schroeter et al. | 431/94 |

*Primary Examiner*—Carroll B. Dority, Jr.
*Attorney, Agent, or Firm*—Edward J. Coleman

[57] ABSTRACT

A photoflash lamp having a glass envelope with a clear protective exterior coating comprising a photopolymer. In applying the coating, the lamp is dipped in a liquid photopolymer and then cure-hardened by a short period of irradiation with a source of ultraviolet light.

4 Claims, 1 Drawing Figure

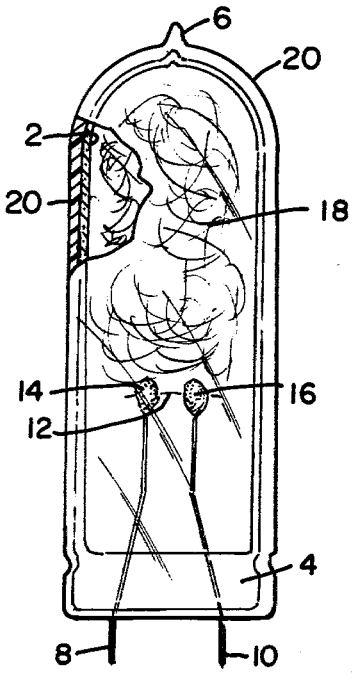
6
20
2
20
18
14
16
12
4
8
10

LAMP WITH PROTECTIVE COATING AND METHOD OF APPLYING SAME

CROSS-REFERENCE TO RELATED APPLICATION

Ser. No. 699,139, filed June 23, 1976, Judith A. Dow and Timothy Fohl, entitled and assigned the same as this invention, describes a fiber-reinforced photopolymer coating.

BACKGROUND OF THE INVENTION

This invention relates to lamps with a protective envelope coating and, more particularly, to a protective coating for flashlamps and a method for applying such a coating.

A typical photoflash lamp comprises an hermetically sealed glass envelope, a quantity of combustible material located in the envelope, such as shredded zirconium or hanfium foil, and a combustion supporting gas, such as oxygen, at a pressure well above one atmosphere. The lamp also includes an electrically or percussively activated primer for igniting the combustible to flash the lamp. During lamp flashing, the glass envelope is subject to severe thermal shock due to hot globules of metal oxide impinging on the walls of the lamp. As a result, cracks and crazes occur in the glass and, at higher internal pressures, containment becomes impossible. In order to reinforce the glass envelope and improve its containment capability, it has been common practice to apply a protective lacquer coating on the lamp envelope by means of a dip process. To build up the desired coating thickness, the glass envelope is generally dipped a number of times into a lacquer solution containing a solvent and a selected resin, typically cellulose acetate. After each dip, the lamp is dried to evaporate the solvent and leave the desired coating of cellulose acetate, or whatever other plastic resin is employed.

In the continuing effort to improve light output, higher performance flashlamps have been developed which contain higher combustible fill weights per unit of internal envelope volume, along with higher fill gas pressure. In addition, the combustible material may be one of the hotter burning types, such as hafnium. Such lamps, upon flashing, appear to subject the glass envelopes to more intense thermal shock effects, and thus require stronger containment vessels. One approach to this problem has been to employ a hard glass envelope, such as the borosilicate glass envelope described in U.S. Pat. No. 3,506,385, along with a protective dip coating. Although providing some degree of improvement in the containment capability of lamp envelopes, the use of dip coatings and hard glass present significant disadvantages in the areas of manufacturing cost and safety. More specifically, the hard glass incurs considerable added expense over the more commonly used soft glass due to both increased material cost and the need for special lead-in wires to provide sealing compatibility with the hard glass envelope. In addition, even though more resistant to thermal shock, hard glass envelopes can also exhibit cracks and crazes upon lamping flashing, and, thus, do not obviate the need for a protective coating.

In the typical solvent dipping process for applying protective coatings, a large number of flashlamps are loaded on a rack and then successively dipped in a solvent solution and oven dried three or four times to build up the desired coating thickness. Such a process is time consuming, uses a relatively large area of production floor space, and involves considerable hand labor, all of which add significantly to manufacturing cost. Further, as the lacquer solution includes a highly flammable solvent, such as acetone, an inadvertant flashing of one of the lamps in either the dip bath or drying oven can ignite the solvent fumes. To substantially reduce or eliminate this hazard, costly automatic extinguishing equipment must be employed. In the event of a solvent ignition, the resulting downtime and consumption of fire extinguishing chemical also adds to the manufacturing cost.

Another approach to providing a more economical and improved containing vessel is described in U.S. Pat. No. 3,893,797, wherein a thermoplastic coating, such as polycarbonate, is vacuum formed onto the exterior surface of the glass envelope. The method of applying the coating comprises: placing the glass envelope within a preformed sleeve of the thermoplastic material; drawing a vaccum in the space between the thermoplastic sleeve and the glass envelope; and, simultaneously heating the assembly incrementally along its length, whereby the temperature and vacuum cause the thermoplastic to be incrementally formed onto the glass envelope with the interface substantially free of voids, inclusions and the like. This method provides an optically clear protective coating by means of a significantly faster, safer and more economical manufacturing process, which may be easily integrated on automated production machinery.

SUMMARY OF THE INVENTION

In view of the foregoing, it is an object of the invention to provide an improved lamp coating and an improved method of applying the coating.

A principle object of the invention is to provide a photoflash lamp having a stronger envelope structure for providing improved containment during flashing.

Another object of the invention is to economically provide an improved containment vessel for a flashlamp.

A further object of the invention is to provide an improved method for applying a protective coating on the glass envelope of a photoflash lamp.

These and other objects, advantages and features are attained, in accordance with the invention, by providing on the exterior surface of the lamp envelope a coating comprising a photopolymer. A preferred coating thickness is about 20 mils.

One embodiment of the improved method comprises: dipping the lamp envelope into a liquid photopolymer, and then cure hardening the photopolymer coating by irradiating the lamp envelope with a source of ultraviolet light for a period of between about 0.1 second and 10 seconds. Thickness of the coating is determined by appropriate adjustment of the viscosity of the liquid photopolymer, by controlling the ratio of withdrawal from the dip tank, or by repeating the dipping operation. According to another embodiment, the liquid photopolymer is sprayed on the lamp envelope prior to irradiation.

When employed on photoflash lamps, this UV curved photopolymer coating exhibits a superior containment capability along with excellent photometric characteristics. The method of applying the coating provides several advantages to the lamp manufacturing process. The process is solvent-free, requires a minimum of floor space, and can be readily adapted to automated lamp production apparatus. Of particular importance, cure time is reduced to a matter of seconds or even tenths of a second, with UV lamps replacing large drying ovens to provide significant space and energy savings. A hard cure is effected immediately, without the need for warehousing to assure a complete cure.

BRIEF DESCRIPTION OF THE DRAWING

This invention will be more fully described hereinafter in conjunction with the accompanying drawing, in which the single FIGURE is an elevational view, partly in section, of an electrically ignitable photoflash lamp having a protective coating in accordance with the invention.

DESCRIPTION OF PREFERRED EMBODIMENT

The teachings of the present invention are applicable to a wide variety of lamps of different sizes and shapes; however, the invention is particularly advantageous as applied to photoflash lamps having tubular shaped envelopes with a volume of less than one cubic centimeter. This advantage rests in the significantly superior containment capability exhibited by small photoflash lamps coated in accordance with the invention. For purposes of example, the invention will be described as applied to the electrically ignitable, filament-type photoflash lamp illustrated in the drawing; however it will be understood that the same principles are applicable to high voltage or percussively ignited flashlamps.

Referring to the drawing, one embodiment of the coated lamp is illustrated comprising an hermetically sealed lamp envelope 2 of glass tubing having a press 4 defining one end thereof and an exhaust tip 6 defining the other end thereof. Supported by the press 4 is an ignition means comprising a pair of lead-in wires 8 and 10 extending through and sealed into the press. A filament 12 spans the inner ends of the lead-in wires, the beads of primer 14 and 16 are located on the inner ends of the lead-in wires 8 and 10, respectively, at their junction with the filament. Typically, the lamp envelope 2 has an internal diameter of less than one-half inch, and an internal volume of less than one cubic centimeter. A combustion supporting gas, such as oxygen, and a filamentary combustible material 18, such as shredded zirconium or hafnium foil, is disposed within the lamp envelope. Typically, the combustion supporting gas fill is at a pressure exceeding one atmosphere, with the more recent subminiature lamp types having oxygen fill pressure of up to several atmospheres. As will be described in more detail hereinafter, the exterior surface of the glass envelope 2 is covered with a protective coating comprising a photopolymer 20.

A percussive type photoflash lamp is described in several prior patents of the present assignee; for example U.S. Pat. No. 3,674,411. As described therein, the percussive lamp also includes a sealed glass envelope containing a filamentary combustible material and a combustion-supporting gas; however, the ignition means comprises a metal primer tube sealed in the depending from one end of the glass envelope and containing a coaxially disposed wire anvil partially coated with a charge of fulminating material.

A high voltage type photoflash lamp is described in a number of patent applications of the present assignee; for example, Ser. No. 673,569, filed Apr. 5, 1976 and now U.S. Pat. No. 4,059,388. As described therein, the lamp includes a sealed glass envelope containing a filamentary combustible material and a combustion-supporting gas; however, the ignition means comprise a mass of primer material bridging a pair of lead-in wires, one of which is enclosed in an insulating sleeve.

Although somewhat different in structure and operation, the filament, high-voltage, and percussive lamps are similar in that in each the ignition means is attached to one and of the lamp envelope and disposed in operative relationship with respect to the filamentary combustible material. More specifically, the igniter filament 12 of the flashlamp of the drawing is incandesced electrically by current passing through the metal filament support leads 8 and 10, whereupon the incandesced filament ignites the beads of primer 14 and 16 which in turn ignite the combustible 18 disposed within the lamp envelope to provide the actinic light output. Operation of the percussive-type lamp is initiated by an impact onto the primer tube to cause deflagration of the fulminating material up through the tube to ignite the combustible disposed within the lamp envelope. Operation of the high-voltage type lamp is initiated when a high voltage pulse from, e.g., a piezoelectric crystal, is applied across the two lead-in wires; electrical breakdown of the primer causes its deflagration which, in turn, ignites the shredded metallic combustible.

In accordance with the present invention, we have discovered a solventless, rapid method for providing an optically clear protective coating on the exterior surface of the glass envelope which results in a superior containment vessel. The method provides a significantly faster, safer and more economical manufacturing process, and it may easily be integrated into automated production machinery. The resulting coating provides a combined envelope structure which is more resistant to both mechanical and thermal shock. As a result, this coating reduces the cost of materials by permitting the use of soft glass to meet higher containment requirements. The improved flash lamp coating comprises a photopolymer, denoted as 20 in the drawing. The term "photopolymer" is understood to mean a radiation curable polymer. Rapid curing of such a polymer results from any stimulus that generates free radicals. For example, free radical initiation can be effectively provided by a source of ultraviolet (UV) light or electron beams.

Ultraviolet light in the 185 to 400 nanometer wavelength range is required for UV cures, with peak sensitivity at about 365 nanometers. UV light from commercial mercury vapor, mercury-metal halide, or pulsed xenon lamps is effective in the required wavelength range.

Curing time with UV light ranges from fractions of a second to minutes depending on film thickness, polymer structure, UV light intensity, and initiator type and concentration. In the present application of coating photoflash lamp envelopes in thicknesses of from 5 to 40 mils, curing time can range between 0.1 second to 10 seconds. Curing can be effected in air, under vacuum, or in an inert gas atmosphere.

The photopolymer basically comprises prepolymers used alone or diluted with reactive monomers. To render the material UV curable, however, one must use a photosensitizer or photoinitiator (such as a benzoin ether) which will directly or indirectly give free radicals when exposed to UV radiation, even at room temperature.

Examples of prepolymers include polyesters, acrylics, polyurethanes, thiolenes, alkenes, or any of a number of general groups. Examples of ractive monomers include styrenes, acrylic, and methacrylic esters, and polyfunctional monomers, such as ethylene glycol diacrylate, trimethylol propane triacrylate, and pentaerythritol tetraacrylate. The monomers also serve as viscosity reducing agents and, as such, they are solvents which dissolve or are miscible with the prepolymer. Accordingly, the reactive monomers reduce the viscosity of the blend to workable levels and/or impact desirable properties to the cured film.

Specific photopolymers we have found to be particularly useful in coating photoflash lamps are thiolene based materials available from W.R. Grace and Co., Maryland and identified as RCC Blend 15 and Blend XRCP-7211. Approximately 99 percent by weight of these thiolene based photopolymers comprise a blend of prepolymers, such as di- or polythiopolymers and di- or polyene-polymers; the balance of the mixture comprises a photoinitiator, such as benzoin ether or aromatic ketone, e.g., benzophenone, and stabilizers, which are small quantities of free radical scavengers.

The flow and viscosity characteristics of the liquid photopolymer can be adjusted by adding fumed silica to increase the thixotropicity of the mixture. The increased viscosity enables application of a heavier coating and reduces gravity induced runback of the wet coating prior to cure. The viscosity can be decreased by heating, or adding monomers as discussed above.

A preferred method of applying the coating in accordance with the invention comprises: first dipping the envelope 2 into a liquid photopolymer, and then irradiating the coated envelope with a source of ultraviolet light for a period between 0.1 second and 10 seconds so as to cure-harden the photopolymer 20 coated on the lamp envelope.

In one specific example of coating a flashlamp of the type used in flashcubes or flash bars, the aforementioned Grace and Co. RCC Blend 15 photopolymer was used. The lamp was dipped into a vat of the photopolymer at 60° C., removed from the vat, and then cured for 5–10 seconds with a quartz jacketed 400 watt mercury lamp. To provide a thicker coating, the lamp was then redipped into the photopolymer at room temperature (about 25° C.) and again UV cured for 5–10 seconds. The average coating thickness was about 14 mils, with about 0.25 grams of photopolymer material on each lamp.

In another example of coating a flashlamp of the type used in flash bars, the aforementioned Grace and Co. Blend XRCP-7211 photopolymer was used. The lamp, held vertically with the base up, was dipped into a vat of the photopolymer at 60° C. and extracted very slowly; the dip process took about 45 seconds. The wet-coated lamp was then inverted with the base down and rotated at a speed of from ½ to 4 revolutions per second under a UV lamp; the cure period was about 30 seconds. The resulting coating thickness was about 0.020 inch. Lamps coated in this manner exhibited significantly improved containment characteristics.

In yet another example, a lamp of the flash bar type was coated by the same method as described in the preceding paragraph but with a photopolymer comprising a blend of polyester resins mixed with about 1 to 3 percent by weight of photoinitiator. The polyester resins were obtained from Reichhold Chemicals, Inc., White Plains, N.Y. In this instance, lamps having a coating thickness of only 11 mils exhibited high containment characteristics.

Although the invention has been described with respect to a specific embodiment, it will be appreciated that modifications and changes may be made by those skilled in the art without departing from the true spirit and scope of the invention. The process may also be automated whereby the flash lamps, while revolving, can be sprayed with the liquid photopolymer and then proceed directly into the ultraviolet chamber.

What we claim is:

1. A lamp having a light-transmitting envelope and an optically clear protective coating formed in situ on the exterior surface of said envelope for significantly enhancing the containment thereof, said coating comprising a single layer of a solvent-free photopolymer having a thickness of at least about 0.020 inch, said photopolymer comprising a UV curable synthetic polymer containing an organic photoinitiator or photosensitizer.

2. The lamp of claim 1 wherein the envelope thereof contains a source of actinic light output.

3. The lamp of claim 2 wherein the envelope thereof contains a fill gas at a pressure exceeding one atmosphere.

4. The lamp of claim 3 wherein said lamp is a photoflash lamp, said envelope is an hermetically sealed glass envelope, said fill gas is a combustion-supporting gas, and said lamp further includes a quantity of combustible material located in said envelope, and ignition means attached to said envelope and disposed in operative relationship to said combustible material.

* * * * *